US006253740B1

(12) United States Patent
Rembold

(10) Patent No.: US 6,253,740 B1
(45) Date of Patent: Jul. 3, 2001

(54) FUEL SUPPLY DEVICE FOR AN INTERNAL COMBUSTION ENGINE

(75) Inventor: Helmut Rembold, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,984

(22) PCT Filed: Jun. 8, 1999

(86) PCT No.: PCT/DE99/01663

§ 371 Date: Apr. 26, 2000

§ 102(e) Date: Apr. 26, 2000

(87) PCT Pub. No.: WO00/00736

PCT Pub. Date: Jan. 6, 2000

(30) Foreign Application Priority Data

Jun. 29, 1998 (DE) ..... 198 28 931

(51) Int. Cl.[7] ..... F02M 37/04
(52) U.S. Cl. ..... 123/509; 123/510
(58) Field of Search ..... 123/509, 510–11, 123/514, 457

(56) References Cited

U.S. PATENT DOCUMENTS

| | | | | |
|---|---|---|---|---|
| 5,289,810 | * | 3/1994 | Bauer et al. | 123/510 |
| 5,330,475 | * | 7/1994 | Woodward et al. | 123/509 |
| 5,415,146 | * | 5/1995 | Tuckey | 123/509 |
| 5,636,616 | * | 6/1997 | Okane et al. | 123/510 |
| 5,762,048 | * | 6/1998 | Yonekawa | 123/510 |
| 5,782,223 | * | 7/1998 | Yamashita et al. | 123/510 |
| 5,785,032 | * | 7/1998 | Yamashita et al. | 123/510 |

FOREIGN PATENT DOCUMENTS 42 42 242 A1 6/1994 (DE) .

* cited by examiner

*Primary Examiner*—Thomas N. Moulis
(74) *Attorney, Agent, or Firm*—Michael J. Striker

(57) ABSTRACT

A system for supplying an internal combustion engine with fuel present in a tank, in which a feed segment for the fuel extends from a feed pump through a fuel filter, is characterized in that the fuel filter includes a prefilter and a fine filter. It is especially suitable for supplying an internal combustion engine by direct injection.

6 Claims, 2 Drawing Sheets

FUEL SUPPLY DEVICE FOR AN INTERNAL COMBUSTION ENGINE

PRIOR ART

The invention is based on a system as generically defined by the preamble to the main claim. From German Patent Disclosure DE 42 42 242, a system for supplying an internal combustion engine with fuel present in a tank is known in which a feed pump and a fuel filter are disposed along a feed segment for the fuel. Fuel supply systems for direct injection into the cylinders of an internal combustion engine require finer filtration of the fuel than conventional systems with intake-tube injection. While in systems for intake-tube injection filter pore widths of 10 $\mu$m are adequate, for direct-injection pore widths of approximately 3 $\mu$m are required.

If in an existing fuel supply system for intake-tube injection only the pore width of the filter used is reduced, the consequence is that the filter becomes stopped up in a considerably shorter time and has to be changed. For the operator of the engine, this means increased maintenance costs and downtimes.

The need by operators for a fuel filter with a long service life could be met until now only by using filters whose dimensions were increased in accordance with the reduction in their pore size. The increased space required by these filters is another disadvantage, especially in internal combustion engines for motor vehicles, where particular emphasis is placed on a compact construction.

ADVANTAGES OF THE INVENTION

The fuel supply system of the invention having the characteristics of claim 1 has the advantage over the prior art of enabling finer filtration of the fuel than previous fuel supply systems for intake-tube injection, without substantially increasing the space needed by the system or shortening the service life of the filters.

By means of the provisions recited in the dependent claims, advantageous refinements of and improvements to the fuel supply system defined by the main claim are possible.

Drawing

Further characteristics and advantages of the invention will become apparent from the ensuing description of exemplary embodiments in conjunction with the accompanying FIGS. 1–4, each of which schematically shows one exemplary embodiment.

Figure 1:
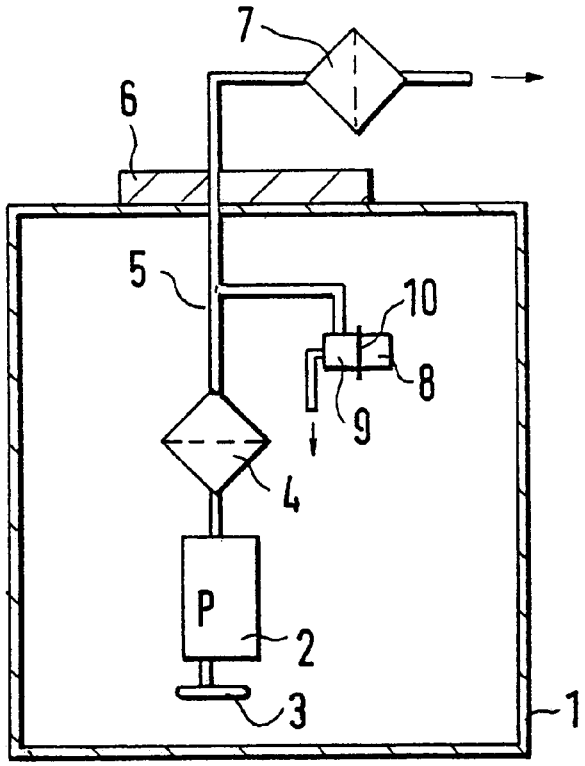

FIG. 1 shows a first example of a system according to the invention for supplying an internal combustion engine with fuel present in a tank 1. The system includes an electric fuel feed pump 2, which is disposed in the interior of the tank 1 and aspirates fuel via an intake neck 3 disposed in the vicinity of the bottom of the tank. A screen is disposed in the outlet neck 3 and protects the fuel feed pump from coarse dirt particles entrained in the aspirated fuel. The screen must present no more than slight resistance to the flow of the fuel; it is therefore usually embodied as a thin, large-mesh membrane of plastic or as a wire-mesh structure. The mesh width of the screen is typically 0.3 mm, if the supply system is used for diesel fuel, and 0.06 mm for fuel for Otto engines. The fuel feed pump is the starting point of a feed segment in the course of which the fuel first flows through a prefilter 4 with a pore width of approximately 8 to 15 $\mu$m, preferably 10 $\mu$m. This filter traps the coarser suspended substances or contaminants in the fuel. Like the feed pump 2, it is disposed inside the tank. The feed segment also includes a feed line 5, which extends from the outlet of the prefilter 4 through a flange 6 to a fine filter disposed outside the tank. The pore width of the fine filter is expediently in the range from 1.5 to 8 $\mu$m and is markedly less, for instance by a factor of 2 to 4, then the pore width of the prefilter 4. If the pore width of the prefilter is 10 $\mu$m, then a value of approximately 3 $\mu$m for the fine filter is expedient. Since only already prefiltered fuel flows through this fine filter, it does not stop as fast as a conventional single-stage filter and can therefore be kept small in its dimensions. From the outlet of the fine filter 7, the feed segment leads on to the carburetor of the engine (not shown).

Since in contrast to the screen, the filters 4 and 7 are located downstream of the feed pump 2, a considerably higher pressure difference can be allowed to occur at these filters in operation.

A line that branches off from the feed line leads to a pressure regulator 8. The pressure regulator 8 includes a pressure chamber 9, which communicates via the branching line directly with the supply line 5 and is bounded on one side by a diaphragm 10. If the pressure in the pressure chamber exceeds a predetermined value, the diaphragm 10 is lifted from a ceiling seat (not shown), and fuel flows out of the pressure chamber 9 back into the tank. In this way, a constant pressure along the feed line 5 is assured, regardless of the pumping capacity of the fuel pump 2.

The feed pump 2, prefilter 4 and pressure regulator 8 are expediently combined with the flange 6 by means of a carrier frame (not shown) to form a module, that when the flange 6 is loosened, can be taken as a unit out of the tank 1 and repaired.

Figure 2:
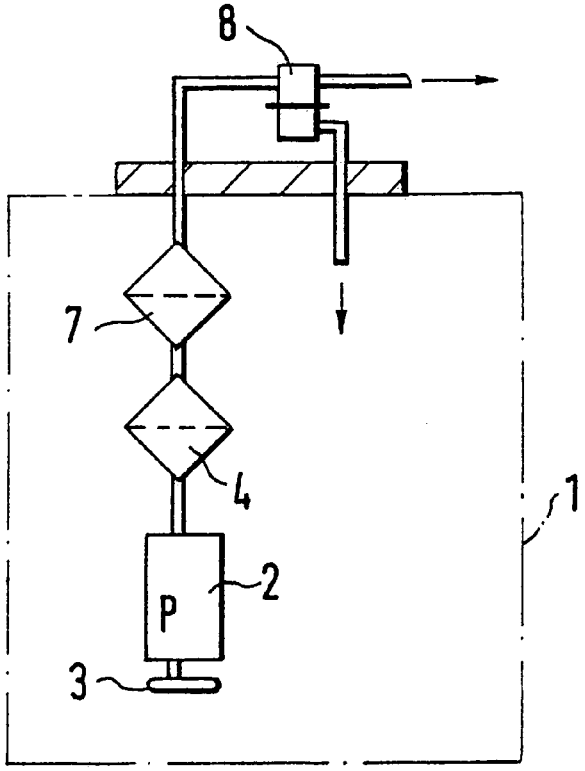

The exemplary embodiment shown in FIG. 2 substantially includes the same components as that of FIG. 1. The substantial distinction between the two examples is that in FIG. 2 the order of the fine filter 7 and pressure regulator 8 is transposed. The fine filter 7 thus directly follows the prefilter 4; they can both be integrated in the same housing. By disposing the pressure regulator downstream of both filters, it is attained that the fuel pressure prevailing at the carburetor (not shown) is subject to lesser fluctuation than in the example of FIG. 1, since it does not depend on a throughput-dependent pressure drop in the fine filter 7.

The pressure regulator 8 shown separately from the flange 6 in schematic FIG. 2 is expediently mounted directly on the flange 6.

Figure 3:
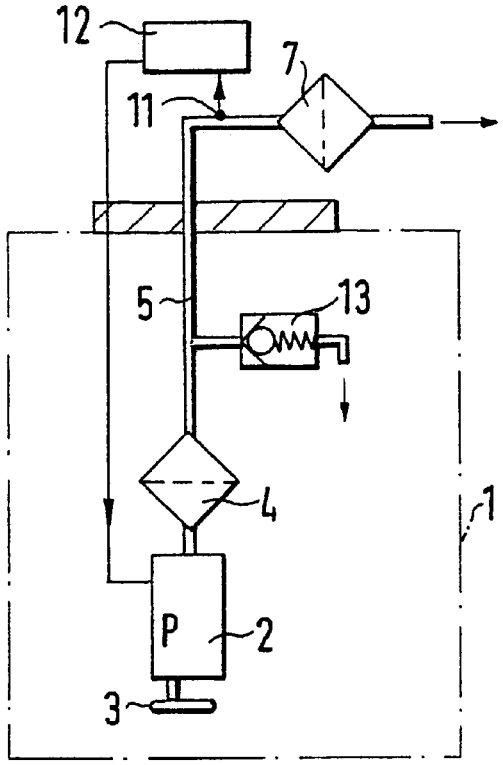

In the exemplary embodiment shown in FIG. 3, a sensor 11 detects the pressure in the feed line 5, and a regulating circuit 12 regulates the pumping capacity of the feed pump in such a way that the pressure detected by the sensor 11 remains substantially constant, at a set-point pressure in a range from about 3 to 5 bar. An overpressure valve 13 in a line that branches from the feed line 5 is adjusted such that it opens at a pressure that substantially exceeds the set-point pressure, for instance at a pressure of about 10 bar. In the event of a problem in pressure regulation, it serves to prevent the occurrence of overpressures in the feed line 5 that could otherwise possibly cause the feed line to leak. The fine filter 7, which as in the example in FIG. 1 is disposed outside the tank 1, is easily accessible for maintenance purposes and can be replaced if it should become stopped up. The prefilter 4 inside the tank can be designed as a lifetime filter.

The disposition of the sensor 11 can differ from what is shown here for the sake of expediency; for instance, it can be disposed downstream of the fine filter 7, or it can be disposed directly at the outlet of the feed pump 2; in the latter case, the sensor 11 and regulating circuit 12 are expediently integrated with the housing of the feed pump 2.

FIG. 2 differs from FIG. 3 in that the fine filter 7 is disposed inside the tank 1, and that the overpressure valve 13 branches off from the feed line 5 downstream from the fine filter 7.

Figure 4:
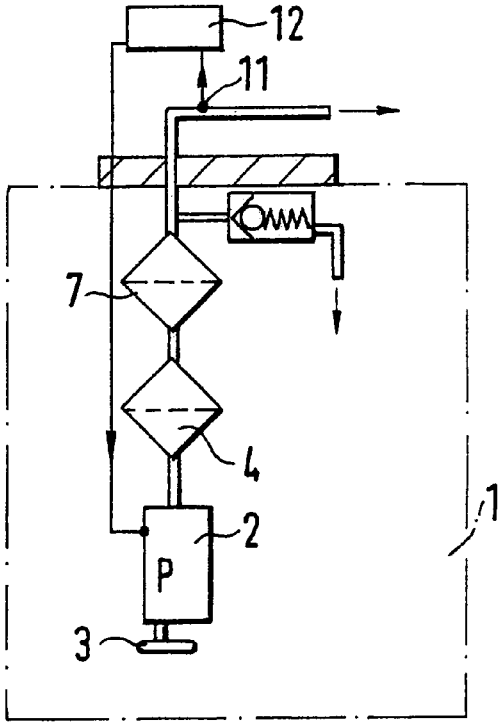

An overpressure valve which is conventionally integrated with the housing of conventional fuel feed pumps directly at the outlet thereof, in order to limit the output pressure of these pumps, can be omitted in the fuel feed pumps shown in FIGS. 3 and 4, because its function is taken over by the overpressure valve 13. Alternatively, the overpressure valve 13 can be dispensed with, if an overpressure valve integrated with the housing of the feed pump 2 is provided.

In the examples, the prefilter 4 and the fine filter 7 are shown as spatially separate units. However, both filters can also be embodied as a one-piece filter body, whose pore width decreases either gradually or in stages from a coarse region that forms a prefilter to a fine-pore region forming a fine filter.

What is claimed is:

1. A system for supplying an internal combustion engine with fuel, comprising a fuel tank; a feed pump feeding fuel from said tank; a fuel filter through which said feed pump feeds fuel from said tank, said fuel filter including a prefilter and a fine filter; and a pressure limiting element located between said prefilter and said fine filter.

2. A system as defined in claim 1, wherein said fine filter has a pore width from 1.5 to 8 $\mu$m.

3. A system as defined in claim 2, wherein said prefilter has a greater pore width than said fine filter, being in a range from 7 to 15 $\mu$m.

4. A system as defined in claim 1, wherein at least said prefilter is built into said fuel tank.

5. A system as defined in claim 1, wherein the system is reflux-free.

6. A system as defined in claim 1, wherein said feed pump is formed so that it aspirates fuel from said fuel tank.

* * * * *